United States Patent [19]

Yoshinari

[11] 4,315,452

[45] Feb. 16, 1982

[54] ELECTRONIC ORGAN PERCUSSIVE MODULATOR

[75] Inventor: David A. Yoshinari, Prospect Heights, Ill.

[73] Assignee: Whirlpool Corporation, Benton Harbor, Mich.

[21] Appl. No.: 62,949

[22] Filed: Aug. 2, 1979

[51] Int. Cl.[3] ..... G10H 1/02

[52] U.S. Cl. ..... 84/1.26; 84/1.19

[58] Field of Search ..... 84/1.13, 1.26, DIG. 12, 84/DIG. 9, 1.19

[56] References Cited

U.S. PATENT DOCUMENTS 4,176,577 12/1979 Yamada et al. ..... 84/DIG. 9
4,210,054 7/1980 Howell et al. ..... 84/1.19

OTHER PUBLICATIONS

Millman and Halkias, *Integrated Electronics,* pp. 95–97.
Lancaster, "Pitch Generators for Electronic Music," in *Popular Electronics,* Mar. 1974.
Lancaster, Imitating Musical Instruments with Synthesized Sound, Popular Electronics, Aug. 1975.
Lancaster, Understanding Octive Filters, *Popular Electronics, Dec. 1976.*

*Primary Examiner*—David Smith, Jr.
*Assistant Examiner*—Forester W. Isen
*Attorney, Agent, or Firm*—Wegner, Stellman, McCord, Wood & Dalton

[57] ABSTRACT

An electronic organ apparatus arranged to provide percussive musical tones by differentiating a rectangular waveform tone signal and subsequently clipping the differentiated signal at a variable level under the control of an envelope signal to produce an improved percussive sound envelope. The time constant of the differentiator may be varied to vary the output sound. The output sound may be controlled by concurrently varying the level of clipping of the differentiated tone signal and varying the time constant of the differentiator. Voicing filters and other modifying inputs may be utilized for further controlling the character of the output sound.

18 Claims, 6 Drawing Figures

DIFFERENTIATED TONE GENERATOR PULSES

MODULATED TONE GENERATOR PULSES
CLIPPING LEVEL VARIED AS f(t)

MODULATED TONE GENERATOR PULSES
CLIPPING LEVEL AND TIME CONSTANT VARIED AS f(t)

SIGNAL PRODUCED BY ENVELOPE GENERATOR

ELECTRONIC ORGAN PERCUSSIVE MODULATOR

BACKGROUND OF THE INVENTION

1. Field of the Invention

This invention relates to electronic organs and in particular to means for producing percussive musical tones in electronic organs.

2. Description of the Background Art

In U.S. Pat. No. 3,022,695, Richard E. Williams shows a percussion circuit having means for differentiating rectangular keying pulses to produce pulses for controlling the gain of an amplifier to which a rectangular waveform tone signal is provided. The system utilizes key-controlled electric light sources with photoelectric means for intercepting light from the light sources with a modulating device modulating the light from each of the light sources according to a musical tone.

Richard H. Peterson shows an electronic musical instrument in U.S. Pat. No. 3,178,499, having diode gate means for applying an envelope to a tone signal in an electronic organ. The diode is used as a portion of a voltage divider and the circuit includes a capacitor for distorting the tone signal waveform. The circuit removes higher order harmonics from the tone signal without effecting any clipping thereof.

Michael R. Harris shows a touch percussion means for an electronic organ with back-to-back diode gates in U.S. Pat. No. 3,558,796. In this circuit, the diode gate operates as a linear modulator and applies an envelope to the tone-colored signal. The system utilizes percussive gates as tone generators wherein the tone signals are passed through a slow percussive linear diode gate to the amplifier and loudspeaker.

In U.S. Pat. No. 3,655,904 of Herbert Cohen, an electric variable tone percussion instrument is disclosed wherein a diode bridge modulator is provided which is controlled by an exponentially decaying voltage applying a percussive envelope to the square wave signal. Switching means are provided for discharging a storage means to provide the exponentially decaying signal across the output means.

John R. Brand et al show an electrical musical instrument in U.S. Pat. No. 3,422,454 wherein a circuit using a diode to clip the rectangular output of a tone generator is utilized to vary the level of the output as a function of time, thereby to apply a percussive envelope to the signal. The envelope is produced by differentiating a keying pulse to produce a sawtooth signal, which is subsequently filtered and applied to the clipping diode. The tone generator signal is not differentiated prior to the clipping. The output signal is passed through a voicing filter after clipping.

Ralph L. Dodds et al, in U.S. Pat. No. 3,593,187, show a noise generator and actuating circuit for a musical instrument for reproducing percussion sounds and the like. A noise generator and noise voicing network is provided for electronically generating white noise which is formed with regard to frequency response and waveform envelope shape to provide a plurality of different voice signal outputs. The noise output signals are varied and controlled by controlling the supply voltage to the noise generator.

Kiyoshi Ichikawa shows a rim-shot-sound-producing device for an electronic organ in U.S. Pat. No. 3,636,801. A percussive sound wave is provided to a clipper circuit and then passed through a differentiation circuit to provide a percussive signal having a richer harmonic content in the beginning portion than in the final portion.

In U.S. Pat. No. 3,637,913 of Chauncey R. Evans, a tone generator is disclosed which provides an asymmetrical rectangular wave having a duty cycle of at least four to one. The rectangular wave is fed to a clipping diode gate where it is modulated in accordance with a signal envelope generated by the player of the piano. A capacitor is connected across the modulator output or within the modulator to provide a modulated rectangular wave with a substantially sawtooth waveform.

SUMMARY OF THE INVENTION

The present invention comprehends an improved method and apparatus for generating percussive musical tones, wherein rectangular tone generator pulses are differentiated and then clipped at a varying level under the control of an envelope control signal. The time constant of the differentiator may be varied as a function of time to provide further control of the output sound.

The circuit utilizes a diode gate for effecting the clipping of the differentiated rectangular pulses.

Means may be provided for variably controlling the differentiator circuit to vary the time constant thereof.

Voicing filters may be utilized to further modify the tone signal produced.

More specifically, the invention comprehends the provision in an electronic organ including a keyboard having a plurality of selectively actuatable keys and tone generator means for producing rectangular pulses at any one of a plurality of different frequencies individually determined by the particular key which is actuated, of improved means for generating percussive tone signals, the generating means including a differentiating circuit coupled to the tone generator means for receiving and differentiating the rectangular pulses to provide differentiated tone signal pulses, a modulator circuit connected so as to receive the differentiated tone signal pulses from the differentiating circuit and having a control input, an envelope signal generating circuit having an output connected to the modulator circuit control input, the envelope generator producing a percussive envelope signal modulating the tone signal pulses at the modulator circuit output as an incident of key actuation, and means for providing an audible sound corresponding to the modulated tone signal produced by the modulator circuit.

The invention further comprehends the provision of means for selectively causing the audible sound to have different preselected characteristics.

The invention also comprehends an improved method of generating percussive musical tones, comprising the steps of differentiating the rectangular pulses to provide differentiated tone signal pulses, generating an envelope signal characteristic of the percussive sounds as an incident of the generation of a keying pulse, clipping the differentiated tone signal pulses at a level which varies as a function of the amplitude of the envelope signal to define a percussive sound waveform, and audibly reproducing the percussive sound waveform.

The apparatus and method of the invention are particularly suited for producing percussive string sounds, such as those produced by a guitar, string bass, banjo, harpsichord, or piano, and percussive brass sounds of the type produced by a trombone or trumpet. While the preferred embodiment of the invention illustrated herein is directed to the production of deep or bass tones produced by these instruments, the invention is also useful for producing percussive tone signals across the full audio spectrum. As will be appreciated by those skilled in the art, the invention effectively provides a complex modulation and filter function which controls the envelope and harmonic content of the tone signal, while requiring only the use of low-cost components in a relatively simple circuit.

BRIEF DESCRIPTION OF THE DRAWINGS

Other features and advantages of the invention will be apparent from the following description taken in connection with the accompanying drawings wherein.

DESCRIPTION OF THE PREFERRED EMBODIMENT

Figure 1:
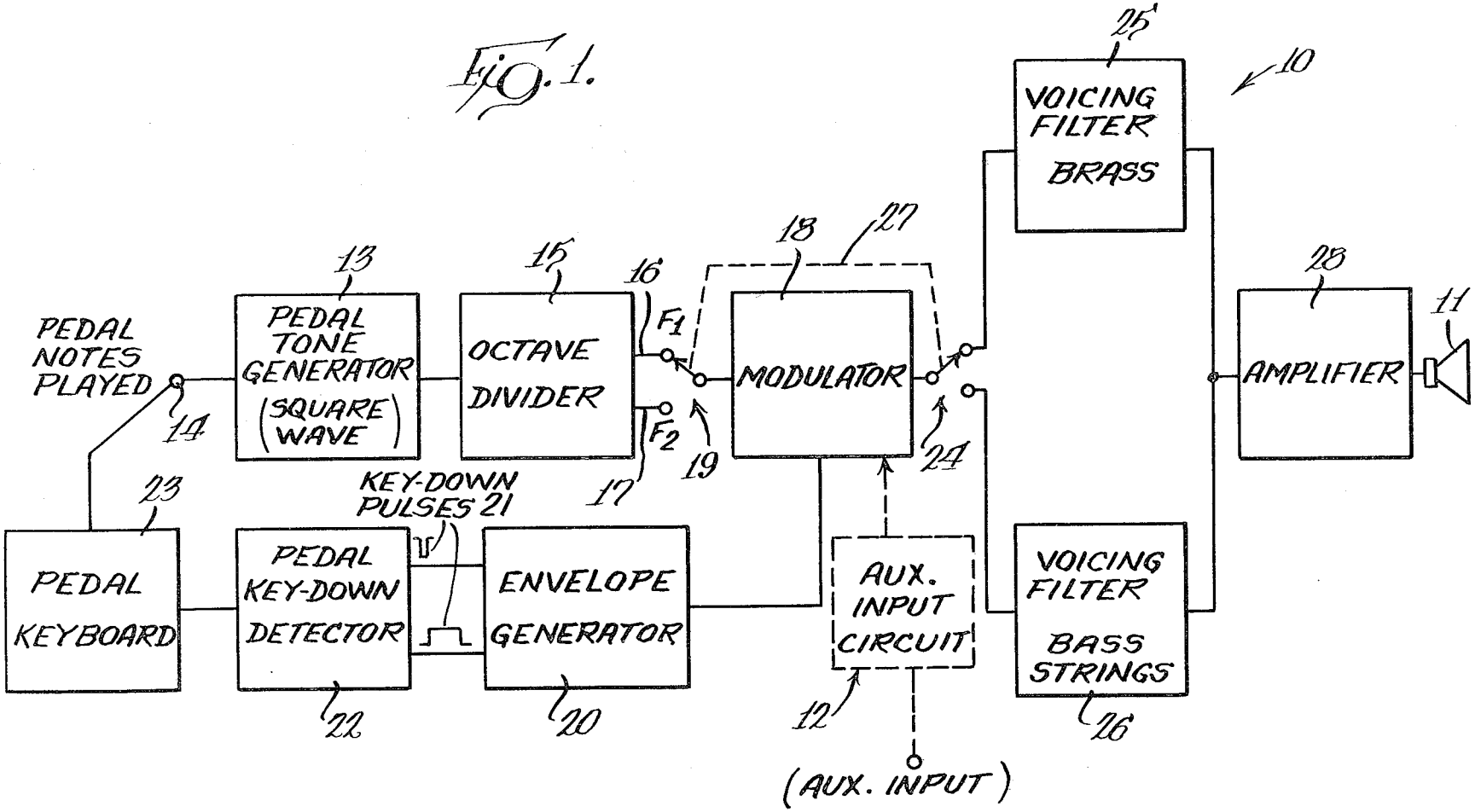
FIG. 1 is a block diagram illustrating the invention as used in an electronic organ.

In the exemplary embodiment of the invention as disclosed in the drawings, an improved electronic organ circuit generally designated 10 is provided for producing sounds through an output speaker 11 simulating the percussive sound of string and brass instruments. The circuit is further arranged in a modified form to utilize an auxiliary input for modifying the harmonic content of the pulses generated in the circuit to provide a wide variety of different musical sound characteristics, such as for example, sounds having characteristics similar to that produced by electronic musical synthesizers. Such an auxiliary input circuit is identified as circuit 12 in FIG. 1.

Reference being made to FIG. 1, the improved organ circuit 10 may include a conventional pedal tone generator 13 for providing a rectangular waveform signal, such as a square wave, as a result of the player of the organ depressing selectively any one of the different pedals of the organ so as to provide an input signal at an input 14 to the generator. The pedal tone generator 13 provides the rectangular wave tone signal, at a frequency selectively determined by the pedal note being played, to an octave divider 15. The octave divider provides a first output 16 at a frequency one octave below the input frequency, and a second output 17 at a frequency two octaves below the input frequency.

Either of the outputs 16 or 17 is selectively provided to a modulator 18 by means of a selector switch 19. Modulator 18 differentiates the signal pulses received from octave divider 15. In addition, modulator 18, under the control of an envelope generator 20, varies the amplitude of the differentiated pulses as a function of time. The envelope generator receives key-down pulses 21 from a conventional pedal key-down detector 22 controlled by the pedal keyboard 23.

The output of modulator 18 is delivered through a selector switch 24 to either a first voicing filter 25 or a second voicing filter 26. Interconnecting means 27 are provided so that when switch 19 is set to deliver the higher frequency signals from octave divider 15 to modulator 18, the output signal is delivered to voicing filter 25, and when switch 19 is set to deliver the lower frequency signals from octave divider 15 to modulator 18, the output of the modulator is delivered to voicing filter 26. As shown in FIG. 1, voicing filter 26 produces a bass string characteristic in the signal, whereas voicing filter 25 produces a brass characteristic in the signal, for selective delivery to a suitable amplifier 28 to provide the drive for the output speaker 11.

As further shown in FIG. 1, the auxiliary input circuit 12 may be connected to the modulator 18 for effecting the further desired control of the tone signals therein.

Figure 2:
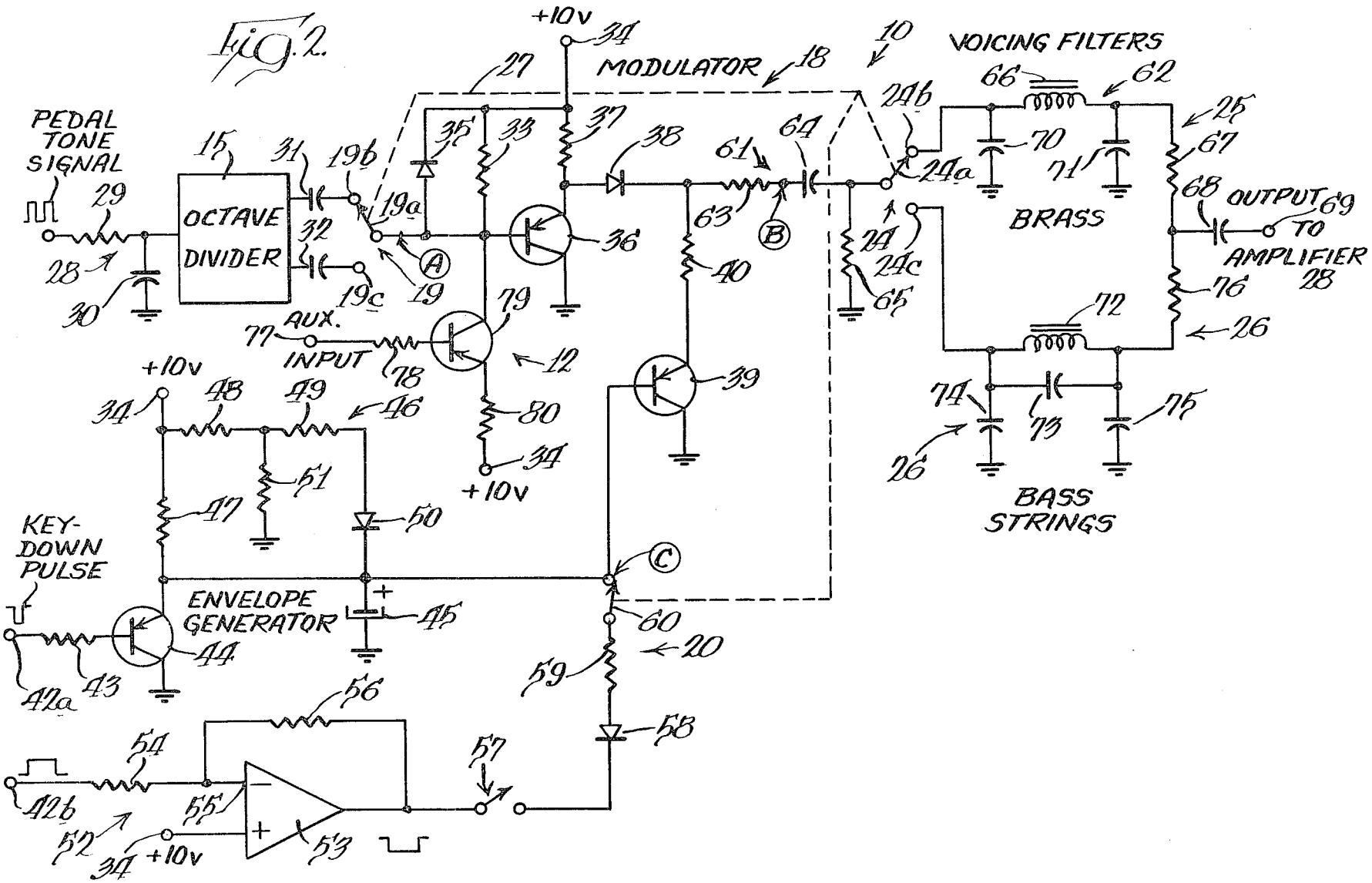
FIG. 2 is a circuit diagram illustrating a preferred form of the invention.

The preferred embodiment of the organ circuit 10 is illustrated more specifically in FIG. 2. The pedal tone signals are delivered to the octave divider 15 which, illustratively, may comprise an RCA CD-4013 divider. The signals may be delivered thereto through a shaping circuit 28 including an input resistor 29 and a capacitor 30. In the illustrated embodiment, resistor 29 may have an ohmic value of 47K and capacitor 30 may comprise a 47 pf capacitor. The shaping circuit shapes the input pulses and removes high frequency noise from the signal.

Selector switch 19 includes a moving contact **19*a* selectively engageable with a first fixed contact 19*b* connected through a first output capacitor 31 to the divider 15, and a second fixed contact 19*c* connected through a second capacitor 32 to the low frequency output of the divider 15. Modulator 18 includes a resistor 33 connected between moving contact 19*a* of switch 19 and the +10 v. power supply 34. Capacitors 31 and 32 cooperate with resistor 33 in defining a differentiator for providing a first control of the sound signals produced. The values of capacitors 31 and 32 and resistor 33 are preselected to provide desired sound characteristics. In the illustrated embodiment, capacitor 31 has a value of 0.0068 $\mu$f, capacitor 32 has a value of 0.01 $\mu$f, and resistor 33 has a value of 47K. In the illustrated arrangement of the differentiator, the mellowness of the output sound is a direct function of the value of the capacitance of capacitors 31 and 32**.

A diode 35 is connected in parallel with resistor 33 so as to provide rapid recovery of the capacitors 31 and 32 after each pulse from the divider 15.

The differentiated pulses are delivered to an amplifier transistor 36 connected through a resistor 37 to the power supply lead 34. In the illustrated embodiment, resistor 37 has a value of 10K. The amplified signal is delivered through a diode 38 which is arranged in circuit 10 to define a modulator or clipper of the amplified differentiated pulses. More specifically, the signal is clipped as a function of the DC level applied to the cathode of the diode, which level is under the control of a transistor 39 which is connected to diode 38 through a resistor 40, which may have a value of 33K. The term "clip" as used herein refers to the limitation of a signal to portions lying on only one side of an amplitude boundary so as to cause a distortion of the signal. As shown, the emitter of the transistor 39 may be connected to ground. Thus, as can be seen in FIG. 2, resistors 37 and 40 cooperate with transistor 39 in defining a variable voltage divider across the power supply for effecting a variation in the DC level at the cathode of diode 38.

Control of the voltage divider through transistor 39 is effected by means of an envelope generator circuit generally designated 20. As illustrated in FIG. 2, the envelope generator circuit includes an input 42*a* for receiving a key-down pulse generated by conventional organ circuitry (not shown) each time a pedal key is depressed. The key-down pulse provided to input 42*a* is preferably of very narrow width, such as one having a pulse width of approximately 2 to 10 milliseconds. The pulse is delivered through a resistor 43 to a transistor 44. In the illustrated embodiment, resistor 43 has a value of 470K. The polarity of the key-down pulse on input 42*a* is such that the pulse drives the transistor into conduction so as to discharge the envelope generator capacitor 45, which is normally maintained in the envelope generator circuit in a fully charged state. To effect such discharge, the collector of transistor 44 is connected to ground, as illustrated.

Recharging of capacitor 45 is effected through a resistor network generally designated 46 including a first resistor 47 connected between power supply lead 34 and the collector of the transistor 44, a second resistor 48 connected in series with a third resistor 49 through a diode 50 to capacitor 45. A fourth resistor 51 is connected from between resistors 48 and 49 to ground. In the illustrated embodiment, resistor 47 has a value of 470K, resistor 48 has a value of 2.2K, resistor 49 has a value of 39K, and resistor 51 has a value of 2.2K. Capacitor 45 comprises a 1 μf capacitor. Resistor network 46 is arranged so that, in recharging capacitor 45, a high current is initially delivered thereto so as to rapidly restore the charge to approximately one-half the supply voltage, after which the charge on the capacitor increases slowly to the supply voltage. As shown, capacitor 45 is further connected to the base of transistor 39 for controlling the voltage divider which, in turn, controls the level of clipping effected by diode 38.

If desired, the envelope control signal delivered to the base of transistor 39 from the envelope generator may be modified to effect a lengthening of the initial portion of the modulation signal envelope. The waveform modifying circuitry, shown generally at 52, includes an operational amplifier 53 which may comprise a conventional type 741 operation amplifier. A broad, positive-going key-down pulse is supplied to input 42*b* from the conventional key-down detector and is delivered through a resistor 54 to the inverting input 55 of the amplifier 53. The key-down pulse delivered to this input should preferably have a duration greater than the attack time of a typical percussive instrument sound, a duration of approximately 150 ms or more being sufficient. The non-inverting input is connected to the power supply lead 34.

In the illustrated embodiment, resistor 54 may have a value of 47K. A 220K resistor 56 may be connected across the amplifier 53 with the output of the amplifier being connected through a user-controlled switch 57, a diode 58, and a resistor 59 to the base of transistor 39. Illustratively, the resistor 59 may have a value of 10K. Diode 58 functions as an isolating diode and, when switch 57 is closed, a signal is superimposed on the signal received at the base of transistor 39 from capacitor 45 so as to lengthen the attack portion of the envelope signal, and thereby produce a characteristic in the sound signal which is referred to in the trade as a "funky" sound. This characteristic is usually associated with brass sounds, rather than string sounds. To permit the use of this modifying signal only when a brass output sound is desired, the switch interconnecting means 27 may further control a switch 60 in series with resistor 59 to close the switch only when switches 19 and 24 are selected to provide a brass sound output.

The clipped differentiated signal from diode 38 is fed through an AC coupling network generally designated 61 to a voicing filter network generally designated 62. The AC coupling network 61 includes a resistor 63, which may have a value of 10K, connected in series with a capacitor 64, which may have a capacitance of 0.22 μf, to the moving contact 24*a* of switch 24. As shown in FIG. 2, moving contact 24*a* selectively engages a first fixed contact 24*b* of the switch and a second fixed contact 24*c* of the switch. As shown, the interconnecting means 27 causes moving contact 19*a* of switch 19 to engage fixed contact 19*b* thereof, moving contact 24*a* of switch 24 to engaged fixed contact 24*b* thereof, and switch 60 to be closed concurrently. When the switches are thrown so as to cause moving contact 19*a* to engage fixed contact 19*c* of switch 19 and moving contact 24*a* to engage fixed contact 24*c* of switch 24, switch 60 is opened as disclosed above.

The AC coupling network 61 further includes a resistor 65 connected from between capacitor 64 and moving contact 24*a* to ground. In the illustrated embodiment, resistor 65 may have a value of 330K.

In the illustrated embodiment, the first voicing filter circuit 25 defines a brass voicing filter including a 1H choke 66 connected from fixed contact 24*b* of switch 24 through a resistor 67 and a capacitor 68 to an output 69 connected to the amplifier 28. Resistor 67 illustratively may have a value of 10K and capacitor 68 illustratively may have a value of 0.22 μf. A capacitor 70 is connected between the input to choke 66 and ground and may have a capacitance of 0.22 μf. A capacitor 71 is connected between the output of choke 66 and ground and may have a capacitance of 0.33 μf. Thus, the brass voicing filter 25 comprises a single stage, low pass, pi section filter reducing the higher harmonics in the signal delivered from modulator 18 to the output 69. The illustrated brass voicing filter is exemplary only, it being obvious that other suitable conventional voicing filter circuits may be utilized within the scope of the invention, including conventional multiple RC section filters.

The bass string voicing filter circuit 26 defines a notched, or elliptical, filter which provides a low pass filtering of the signal when the lower frequency signal from divider 15 is being utilized under the control of switches 19 and 24. Thus, as shown in FIG. 2, the bass string voicing filter includes a choke 72 connected in parallel with a capacitor 73. The choke may have an inductance of 1H and the capacitor illustratively may have a capacity of 0.0047 μf. A second capacitor 74 is connected between the input to choke 72 and ground, and a third capacitor 75 is connected between the output of choke 72 and ground. In the illustrated embodiment, capacitors 74 and 75 may have capacitances of 0.015 μf each. As shown, the output of the choke 72 is delivered through a resistor 76 through capacitor 68 to terminal 69. In the illustrated embodiment, resistor 76 has a value of 56K. Thus, the illustrated embodiment bass string voicing filter is arranged to provide a notch at approximately 1.5 to 2KHz, thereby providing the characteristics of deep percussive string sounds, such as produced by bass guitars and the like.

Figure 3:
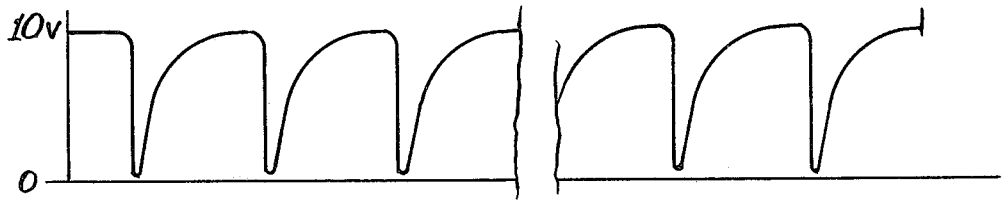
FIG. 3 is a waveform diagram illustrating a differentiated pulse waveform appearing at point A of the circuit diagram.
Figure 4:
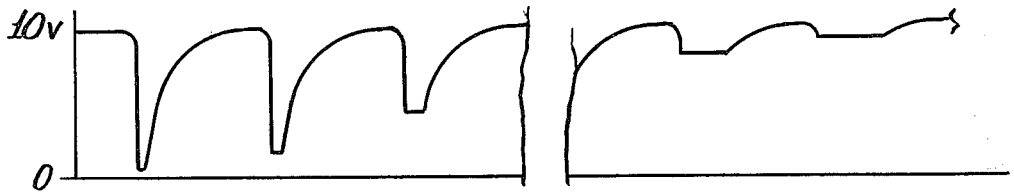
FIG. 4 illustrates a waveform appearing at point B of the circuit.

Referring to FIGS. 3 and 4, the differentiated pulse waveform applied to the base of transistor 36 resulting from the differentiation action of the capacitors 31 or 32 and resistor 33 is illustrated. Negative-going pulses are illustrated because this is the polarity required when transistor 36 comprises a PNP device, as shown in FIG. 2. These pulses, appearing at point A of FIG. 2, are of constant amplitude and have a frequency which is equal to the fundamental tone of the pedal note played.

The modulated tone generator pulses waveform having a variably clipped level, as produced at point B of FIG. 2, is illustrated in FIG. 4. This figure illustrates the waveform which results upon the actuation of a pedal note, and illustrates how the amplitude of the negative-going pulses decreases as a function of time under control of the signal from the envelope generator 20.

Figure 5:
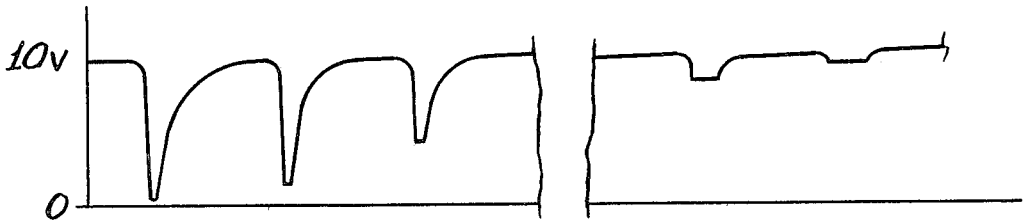
FIG. 5 illustrates a modified waveform appearing at point B.
Figure 6:
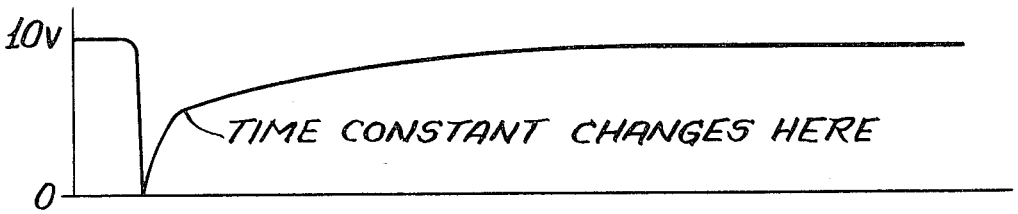
FIG. 6 illustrates a waveform of the signal produced by the envelope generator as appearing at point C of the circuit.

FIG. 6 illustrates the percussive envelope signal produced by the envelope generator 20. This signal which appears at point C of FIG. 2, is also negative-going. The change in time constant illustrated in this figure is due to the previously described operation of network 46, which controls the charging of capacitor 45. It should be noted that the waveform illustrated in FIG. 6 is not drawn to scale with the waveforms shown in FIGS. 3–5.

As indicated briefly above, further modification of the input signal may be provided by means of an auxiliary input circuit 12. As shown in FIG. 2, the auxiliary input circuit 12 includes an input terminal 77 connected through a resistor 78 to the base of a transistor 79 having its collector connected to the base of transistor 36 and its emitter connected through a resistor 80 to the power supply lead 34. In the illustrated embodiment, resistors 78 and 80 each have a value of 10K.

The effect of the auxiliary circuit 12 is to modify the time constant of the differentiating circuit defined by capacitors 31 and 32 and resistor 33. It has been found that synthesizer-like sound can be produced by modifying this time constant as a function of time. Such modification may be effected by having the auxiliary input 77 connected to the output of the envelope generator circuit 20. The auxiliary input circuit functions so as to effectively define a variable shunt for the resistor 33 so as to modify the time constant of the differentiator circuit.

Such modification of the time constant of the differentiator varies the shape of the tone signal pulses applied to the modulator circuit 18. In the illustrated embodiment, the value of the shunt resistance across the resistor 33 is decreased as the drive to the transistor 79 is increased, thereby effectively decreasing the time constant of the differentiating circuit. The resultant narrower tone signal pulses have a modified harmonic content so that a wide range of effects may be obtained as a function of the manner in which the drive of transistor 79 is effected by the input signal applied to terminal 77. As indicated above, such decrease in the time constant of the differentiator may produce an output sound simulating that produced by musical synthesizers and the like. If desired, a control signal other than that produced by the envelope generator can be applied to the auxiliary input.

The use of the auxiliary input circuit 12 and the voicing filters is optional. Illustratively, the output from switch 24 may be delivered directly to the output terminal 69 with the sound produced by the circuit being reasonably close to the desired percussive musical sound.

In the illustrated embodiment, PNP transistors have been utilized. Where NPN transistors are utilized, positive-going waveforms in lieu of the negative-going waveforms of FIGS. 3–6 would be produced. The waveform illustrated in FIG. 5 is produced when the auxiliary input of circuit 12 produces a gradually increasing shunt resistance across the resistor 33 so as to provide a gradually decreasing time constant in the differentiating circuit as a function of time. As shown in FIG. 5, the signal at output point B therefore not only varies as to clip level, but also as to effective pulse width.

Thus, the invention comprehends a novel method and circuit for producing percussive musical tone signals in an electronic organ wherein differentiated tone generator pulses are clipped at a level which varies as a function of time. The invention comprehends effecting such clipping by delivering the rectangular tone generator pulses to a clipping diode which is biased by a variable voltage divider circuit, permitting selective control of the clipping level as a function of the voltage applied to the cathode of the diode.

The invention further comprehends an improved sound producing circuit for an electronic organ wherein the time constant of the differentiator may be varied as a function of time to provide further modification of the processed signal.

The circuit of the present invention is extremely simple and economical, utilizing a relatively small number of components. The circuit is intended for use in conventional electronic organs, and operates using input signals normally found or easily produced on such organs.

The foregoing disclosure of specific embodiments is illustrative of the broad inventive concepts comprehended by the invention.

Having described the invention, the embodiments of the invention in which an exclusive property or privilege is claimed are defined as follows:

1. In an electronic organ including a keyboard having a plurality of selectively actuatable keys, and tone generator means for producing rectangular pulses at any one of a plurality of different frequencies individually determined by a particular key which is actuated, means for generating sounds simulating percussive tones produced by musical instruments, said generating means comprising:

a differentiating circuit coupled to said tone generator means for receiving and differentiating said rectangular pulses to provide differentiated tone generator pulses;

a modulator circuit connected so as to receive said differentiated tone generator pulses from said differentiating circuit and having a control input and means for clipping so as to distort said tone generator pulses at a level determined by a signal applied to said control input;

an envelope signal generating circuit having an output connected to said modulator circuit control input, said envelope generator producing a percussive envelope signal provided to said control input for causing variable clipping by said clipping means of said differentiated tone generator pulses as an incident of each key actuation, the waveshape of said variably clipped differentiated tone generator pulses being non-rectangular; and means for providing an audible sound corresponding to the variably clipped differentiated tone generator pulses produced by said modular circuit.

2. The electronic organ of claim 1 wherein said modulator circuit comprises means for clipping the amplitude of the differentiated tone signal pulses at a level which varies as a function of the percussive envelope signal received at its control input from said envelope generating circuit.

3. The electronic organ of claim 1 wherein said differentiating circuit exhibits a time constant of differentiation and said percussive sound generating means further includes means for adjusting said time constant.

4. The electronic organ of claim 1 wherein said modulator circuit comprises a clipping diode which receives said differentiated pulses and voltage divider circuit for variably biasing the clipping diode in conformity with said percussive envelope signal.

5. In an electronic organ including a keyboard having a plurality of selectively actuatable keys, and tone generator means for producing pulses at any one of a plurality of different frequencies individually determined by a particular key which is actuated, means selectively generating sounds simulating percussive tones such as those produced by string and brass instruments, said generating means comprising:

a differentiating circuit coupled to said tone generator means for receiving and differentiating said pulses to provide differentiated tone generator pulses;

a modulator circuit connected so as to receive said differentiated tone generator pulses from said differentiating circuit and having a control input and means for clipping so as to distort said tone generator pulses at a lever determined by a signal applied to said control input;

an envelope signal generating circuit having an output connected to said modulator circuit control input, said envelope generator producing a percussive envelope signal provided to said control input for causing variable clipping by said clipping means of said differentiated tone generator pulses as an incident of each key actuation, the waveshape of said variably clipped differentiated tone generator pulses being non-rectangular;

means for providing an audible sound corresponding to the variably clipped differentiated tone generator pulses produced by said modulator circuit; and sound modification means connected in circuit with said modulator for causing said audible sound to have preselected characteristics.

6. The electronic organ of claim 5 wherein said sound modification means comprises a pair of voicing filters and switching means for selectively causing the output of said modulator to pass through a first one of said filters which imparts the characteristics of percussive string instruments or a second one of said filters which imparts the characteristics of percussive brass instruments.

7. The electronic organ of claim 5 wherein said sound modification means comprises means for adjusting the width of said differentiated tone signal pulses.

8. The electronic organ of claim 5 further including divider means interposed between said tone generator and said differentiator for selectively dividing the frequency of the pulses from said tone generator.

9. A method of generating sounds in an electric organ simulating the percussive tones produced by musical instruments comprising the steps of:

causing production of a rectangular tone generator pulse train at a frequency determined by the note played;

differentiating the rectangular pulses of said train to provide a differentiated tone generator pulse tone;

generating an envelope signal characteristic of said percussive sounds as an incident of the playing of each note;

clipping said differentiated tone generator pulses of said train at a level which varies as a function of the variable amplitude of said envelope signal so as to produce a variable amplitude non-rectangular percussive sound waveform; and audibly reproducing the percussive sound waveform.

10. The percussive sound generating method of claim 9 wherein said step of clipping said differentiated tone generator pulses comprises a step of altering the harmonic content of said pulses as a function of the amplitude of said envelope signal.

11. The percussive sound generation method of claim 9 wherein said step of differentiating said tone generator pulses comprises a step of varying the time constant of differentiation as a function of time.

12. The percussive sound generating method of claim 9 including the step of filtering the percussive sound waveform.

13. The percussive sound generating method of claim 9 including the step of adjustably varying the width of the clipped tone differentiated generator pulses as a function of time.

14. The percussive sound generating method of claim 9 including the step of dividing the frequency of the train of rectangular pulses to two different divided frequencies, and selectively differentiating only one of the divided frequency pulses.

15. In an electronic organ including a keyboard having a plurality of selectively actuatable keys, and tone generator means for producing pulses at any one of a plurality of different frequencies individually determined by a particular key which is actuated, means selectively generating sound simulating percussive tones such as those produced by string and brass instruments, said generating means comprising:

a differentiating circuit coupled to said tone generator means for receiving and differentiating said pulses to provide differentiated tone generator pulses;

a modulator circuit connected so as to receive said differentiated tone generator pulses from said differentiating circuit and having a control input and means for clipping so as to distort said tone generator pulses at a level determined by signal applied to said control input;

an envelope signal generating circuit having an output connected to said modulator circuit control input, said envelope generator producing a percussive envelope signal provided to said control input for variable clipping by said clipping means of said differentiated tone generator pulses as an incident of each key actuation, the waveshape of said variably clipped differentiated tone generator pulses being non-rectangular;

means for providing an audible sound corresponding to the variably clipped differentiated tone generator pulses produced by said modulator circuit; and sound modification means connected in circuit with said differentiator for causing said audible sound to have preselected characteristics.

16. The electronic organ of claim 15 wherein said sound modification means comprises means for modifying the time constant characteristic of the differentiating circuit.

17. The electronic organ of claim 15 further including divider means interposed between said tone generator and said differentiator for selectively dividing the frequency of the pulses from said tone generator.

18. The electronic organ of claims 1, 5 or 15 wherein said clipping means effects one-sided clipping of said differentiated tone generator pulses.

* * * * *